US007874750B2

(12) United States Patent
Lemoine

(10) Patent No.: US 7,874,750 B2
(45) Date of Patent: Jan. 25, 2011

(54) SYSTEMS AND METHODS FOR PRINTING MULTI-LAYER DOCUMENTS

(75) Inventor: Michel Lemoine, Grez-Doiceau (BE)

(73) Assignee: Xerox Corporation, Norwalk, CT (US)

( * ) Notice: Subject to any disclaimer, the term of this patent is extended or adjusted under 35 U.S.C. 154(b) by 759 days.

(21) Appl. No.: 11/771,320

(22) Filed: Jun. 29, 2007

(65) Prior Publication Data

US 2009/0003916 A1 Jan. 1, 2009

(51) Int. Cl.
*B41J 29/38* (2006.01)
*B65H 39/16* (2006.01)
*B41F 13/02* (2006.01)

(52) U.S. Cl. ..... 400/76; 399/77; 399/78; 399/407; 270/1.01; 270/1.02; 270/1.03

(58) Field of Classification Search ..... 270/1.02, 270/1.03, 1.01, 10
See application file for complete search history.

(56) References Cited

U.S. PATENT DOCUMENTS 4,235,430 A * 11/1980 Fulk ..... 270/52.1
5,608,639 A * 3/1997 Twardowski et al. ..... 700/125
5,707,055 A * 1/1998 DeJoseph et al. ..... 270/52.02
5,915,089 A * 6/1999 Stevens et al. ..... 709/202
6,786,149 B1 * 9/2004 Lomoine et al. ..... 101/223
6,965,444 B1 * 11/2005 Shimada et al. ..... 358/1.15
7,040,820 B2 5/2006 Perdu et al.
2003/0228181 A1 * 12/2003 Fletcher ..... 399/384

* cited by examiner

*Primary Examiner*—Daniel J Colilla
(74) *Attorney, Agent, or Firm*—Oliff & Berridge, PLC

(57) ABSTRACT

A system for printing a multi-layer document includes no less than two continuous feed simplex printing devices that each print on no more than one of a plurality of media webs. An in-line post-processing device merges the media webs into a multi-layer document. The system also may have a controller that controls the printing devices and the post-processing device from a single synchronized dataflow. A method prints a multi-layer document, including the steps of simultaneously printing on no less than two media webs by a plurality of roll fed printers that each print on only one of the media webs; and merging the media webs from the plurality of roll fed printers in an inline post-processing device.

10 Claims, 9 Drawing Sheets

SYSTEMS AND METHODS FOR PRINTING MULTI-LAYER DOCUMENTS

BACKGROUND

This invention relates generally to continuous feed printing systems, and more particularly to continuous feed printing systems that print multi-layer documents.

Continuous feed printers print on a continuous web of printing media such as paper instead of discrete separate sheets. The media web is typically dispensed from a roll of printing media that is separated into single sheets after printing is complete. Continuous feed printing systems are used in many industries for printing such items as forms and checks, and are generally preferred for high speed production print jobs.

SUMMARY

An exemplary embodiment of a continuous feed printing system includes no less than two, and preferably no more than six, simplex continuous feed printers and a plurality of print-related devices for providing pre-processing and post-processing operations to effect printing of multi-layer documents. Simplex printers print on only one-side of a two-sided media web. Duplex printing using simplex printers may be accomplished by feeding a single media web to two simplex printers in series so that one simplex printer prints on one side of the media web and the second simplex printer prints on an opposite side of the media web.

The printing devices and the print-related devices may be connected to a common print line bus (also referred to as Print Line Bus or PLB) for receiving operation signals from a controller. When printing simplex in non-simplex mode, the printing devices also may be connected to a local network. Print data used in performing a desired print job is provided to the various printing devices via transmission through the local network. The local network is separate from the PLB. A PLM may be implemented as a separate hardware or software module or as a software layer installed within the printers. The printing system may use printing devices and associated pre and post processing devices that are interconnected by a common hardware link, such as a print bus line, and may employ the print line segmentation system, method and the continuous feed printing system as described in co-assigned, U.S. Pat. No. 6,786,149 B1 for "High Speed Continuous Feed Printing System,") the disclosure of which is incorporated herein by reference in its entirety.

Embodiments of the printing system provide a general solution to printing multi-layer documents utilizing high speed continuous feed printers in a single inline process. Conventional systems for producing multi-layer documents printed on high speed continuous feed printers require merging the different layers in cumbersome offline processes, which make the synchronization of the different layers more difficult and open doors to potential front-to-back mismatch. That is desired is a continuous feed printing system that utilizes existing print line management continuous feed systems that provide the capability of printing and merging multiple layers inline from a single synchronized data flow. There also is a desire for a continuous feed controller that receives document data flow and separates the incoming document data flow to create separate data layer flows that are sent to different individual high speed printers. It also is desirable to provide a continuous feed controller that controls the operation of a plurality of continuous feed printers operated in parallel and a single postprocessor downstream of the plurality of printers which merges the output from the printers into a multi-layer document.

In embodiments of a system for printing a multi-layer document, the system includes no less than two, and preferably no more than six, continuous feed simplex printing devices, with each of the printing devices printing on no more than one of a plurality of media webs; and a post-processing device that merges the media webs into a multi-layer document. The system may be configured for duplex printing on one of the media webs by operating one or more sets of two simplex printers in series.

The system may further include a controller that controls the printing devices and post-processor device based on a single synchronized dataflow. In embodiments, the controller receives a document data flow, and creates from the document data flow two or more data layer flows. Each of the data layer flows is sent by the controller to one of the printing devices. The controller may synchronize the operation of a post-processing device that merges the printed media webs from each of the printing devices into a multi-layer document. In creating the data layer flows, the controller, such as for example, a Data Master (DM) controller, may duplicate data flows so that two or more of the data layer flows are the same. The controller also may separate the document data flow into the respective data layer flows. The controller may further control at least one pre-processing device for each media web.

Exemplary methods are provided for printing a multi-layer document, including simultaneously printing on two or more roll fed printers that each print on only one of a plurality of media webs, merging the media webs from the plurality of roll fed printers in an inline post-processing device, and synchronizing the plurality of printers and the post-processing device.

These and other objects, advantages and salient features are described in or apparent from the following detailed description of exemplary embodiments.

BRIEF DESCRIPTION OF THE DRAWINGS

Exemplary embodiments will be described with reference to the drawings, in which like numerals represent like parts, and wherein:

FIG. 5(*b*) illustrates a multi-layer document having the same data printed on each layer;

FIG. 5(*c*) illustrates a multi-layer document having distinctive data printed on each layer;

DETAILED DESCRIPTION OF EMBODIMENTS

Figure 1:
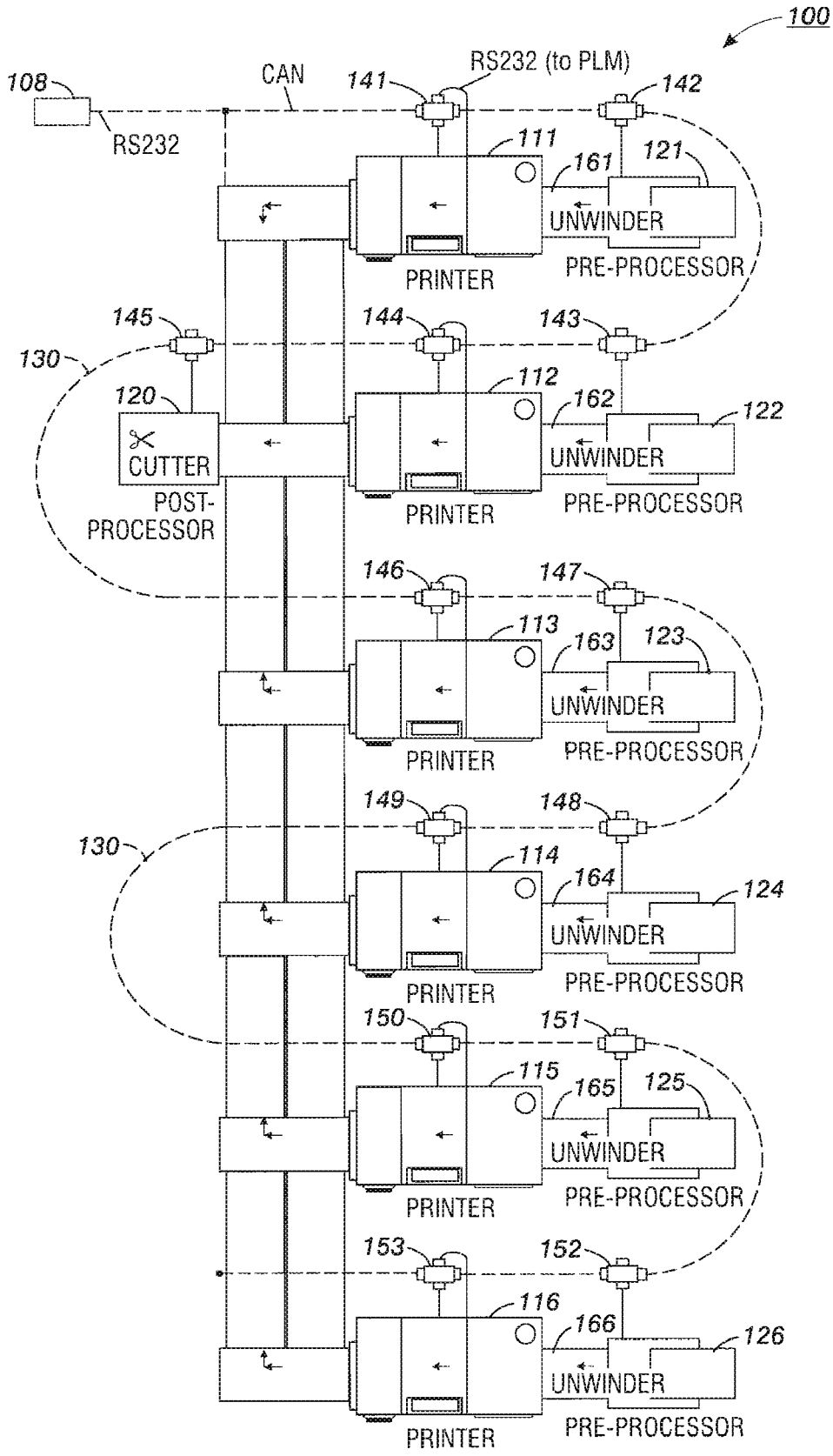
FIG. 1 illustrates an exemplary embodiment of a continuous feed printing system for printing multi-layer documents that utilizes six continuous feed printers.

In the following description, reference is made to the drawings. In the drawings, like reference numerals have been used throughout to designate similar elements.

In simplex printing, a single simplex continuous feed printer prints on one side of a media web. In duplex printing, two continuous simplex feed printers print on different sides of the same media web. One printer prints on one side of the media web and the second printer receives the printed media web that comes from the first printer and prints on the opposite side of the media web. Thus, in duplex printing a single paper path links the two printers. The paper path is the succession of devices through which the paper is transported during the printing process.

Referring now to the drawings, FIG. 1 illustrates a continuous feed printing system 100 in which six printing devices 111-116 are connected as simplex feed printers. Each of the printing devices 111-116 prints on one of a plurality of media webs 161-166 supplied to the printing devices by a corresponding pre-processing device 121-126 such as an unroller or unwinder. The printed media webs 161-166 from the printing devices 111-116 are merged in a single post-processing device 120 into a multi-layer document. The printing devices 111-116, pre-processing devices 121-126, and post-processing device 120 are connected to a common PLB 130 by means of associated PLB adapters 141-153. The PLB adapters 141-153 are powered via the PLB 130 by a power supply (not shown). A corresponding controller 108, or print line management unit, may be connected, for example via a RS232 cable to any one of the PLB adapters 141-153. Communication between the controller 108 and the corresponding PLB adapters 141-153 may be performed. In this embodiment, the controller 108 is separate from the other devices. In other embodiments, the controller 108 may be provided using a software layer running in one or more of the printing devices 111-116.

In the following description, the terms "printing device" and "paper master" are synonymously used to designate the devices 111-116. The terms "print line bus adapter," "PLB adapter" and "adapter" are synonymously used to designate the devices 141-153. The terms "pre-processing device," "pre-processor" and "pre-processor paper slave" are synonymously used to designate the devices 121-126. The terms "post-processing device," "post-processor" and "post-processor paper slave" are synonymously used to designate the device 120. The term "paper slave" is further used to designate any of the devices 120 and 121-126. The terms "media web," "web," and paper are synonymously used to describe media 161-166.

Each printing device 111-116 preferably represents a paper master, a device that has the capability to direct the paper movement. Usually the paper master also has the capability to physically drive the paper. When there are several paper masters in a single paper path, they should be synchronized to effectively transport the common media web along the paper path. The paper masters herein may be continuous feed printers. A continuous feed printer, in contrast to cut sheet printer which prints on separated sheets, prints on a media web, such as from a roll of paper. In some embodiments, the continuous feed printer drives the paper using sprocket holes on its sides. Optionally, "pinless" friction drives or other technology is possible to drive the paper.

The post processor 120 and each PLB adaptor 141-153 preferably represent a paper slave, i.e., a device that does not have the capability to decide by itself to pull/move the paper. The paper slave may be able to actually drive the paper but it requires an external request command to do so. The paper slave also may request the paper movement, but will wait for a request/command from a paper master of the segment to actually move paper. Typically, a paper slave will regulate its speed based on the pace set by (one of) the paper masters by regulating/synching on a paper loop or by receiving a paper advance clock signal and following it.

Pre- and post-processors 121-126 and 120 are devices that feed paper into and accept printed output from a printer 111-116. Pre- and post-processors 121-126 and 120 are preferably adapted to the printing requirements. For example in a continuous feed printing environment a typical high-speed paper path is achieved using a roll unwinder as a pre-processor 121-126 and a re-winder, burster/trimmer/stacker, a cutter, an inserter (in envelopes), post-printers, labels stickers and so on as post-processor 120).

The PLB 130 is used to interface different paper masters and paper slaves in the print system 100 according to a defined print line segment. Each paper master 111-116 and each paper slave 120 and 141-153 is associated with a microprocessor controlled PLB adapter 141-153 used to connect the corresponding paper master 111-116 or slave 120 and 141-153 to the PLB 130. Each PLB adapter 141-153 interfaces to its associated device using the device's own/native signals. The adapters 141-153 are connected to the PLB 130 for power and communication, whereby the communication may be based on an automotive serial protocol known for its real-time and intrinsic security features.

The PLB adapters 141-153 are used to interface the associated paper masters, 111-116 and slaves 120-126 to the PLB 130 and may be used to serve to establish a segmentation of the print system 100. The PLB adapters 141-153 serve for managing established print line segments by filtering data traffic transmitted over the PLB 130, such that associated devices only receive messages sent thereto.

The paper masters 111-116 in the print system 100 according to FIG. 1 may be electrophotographic printing devices or any other suitable printing or document reproduction devices such as inkjet printers or the like. The paper masters 111-116 each include a document output region or assembly which outputs original printed documents or reproduction of printed documents, which are printed on the media web 161-166.

Any pre-processor paper slave 141-153 in the print system 130 includes at least an output region for feeding paper into a subsequent paper master 111-116. The post-processor paper slave 120 includes an input interface which receives paper from the output region of the preceding paper masters 111-116 and further includes a paper output region for outputting processed paper. The processed paper represents a multi-layer document. The input interface of any paper master 111-116 or slave 120 may include a mechanical interface such as a vacuum sheet transport surface, roller transport assembly, or the like for paper transport in a predetermined print line direction. The PLB 130 serves for the transmission of control signals between the paper masters 111-116 and slaves 120-126.

Figure 2:
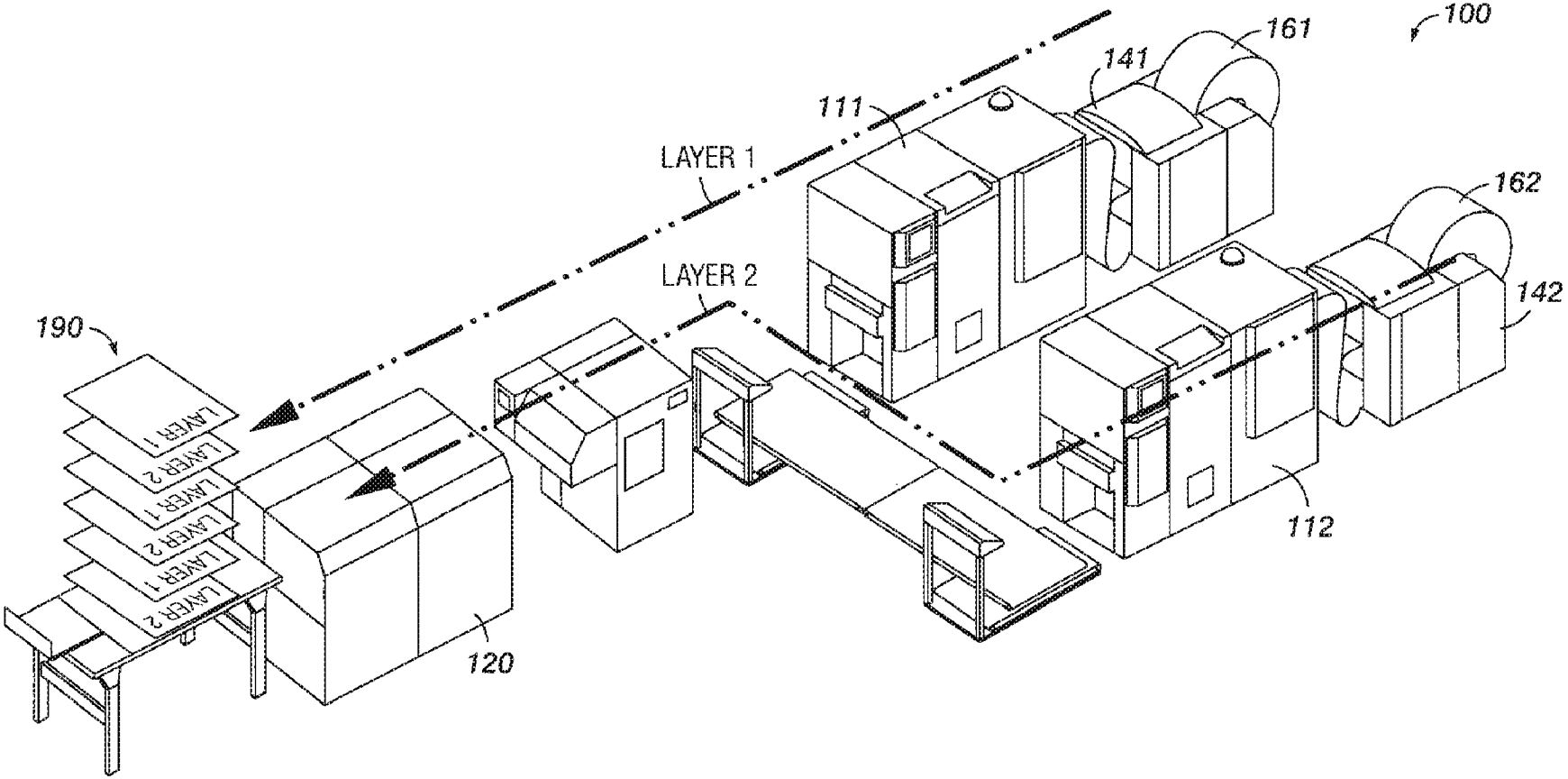
FIG. 2 illustrates an exemplary embodiment of a continuous feed printing system for printing multi-layer documents that utilizes two continuous feed printers.

As shown in FIG. 2, an exemplary embodiment of a two-printer continuous printing system provides two continuous feed printing devices 111 and 112 for use in printing on two media webs 161 and 162. The printed media webs 161 and 162 from the printing devices 111 and 112 are merged into a multi-layer document 190 in a post-processing device 120. Each media web 161 and 161 is fed to the respective printing device 111 and 112 by a dedicated pre-processing device 141 and 142.

Figure 3:
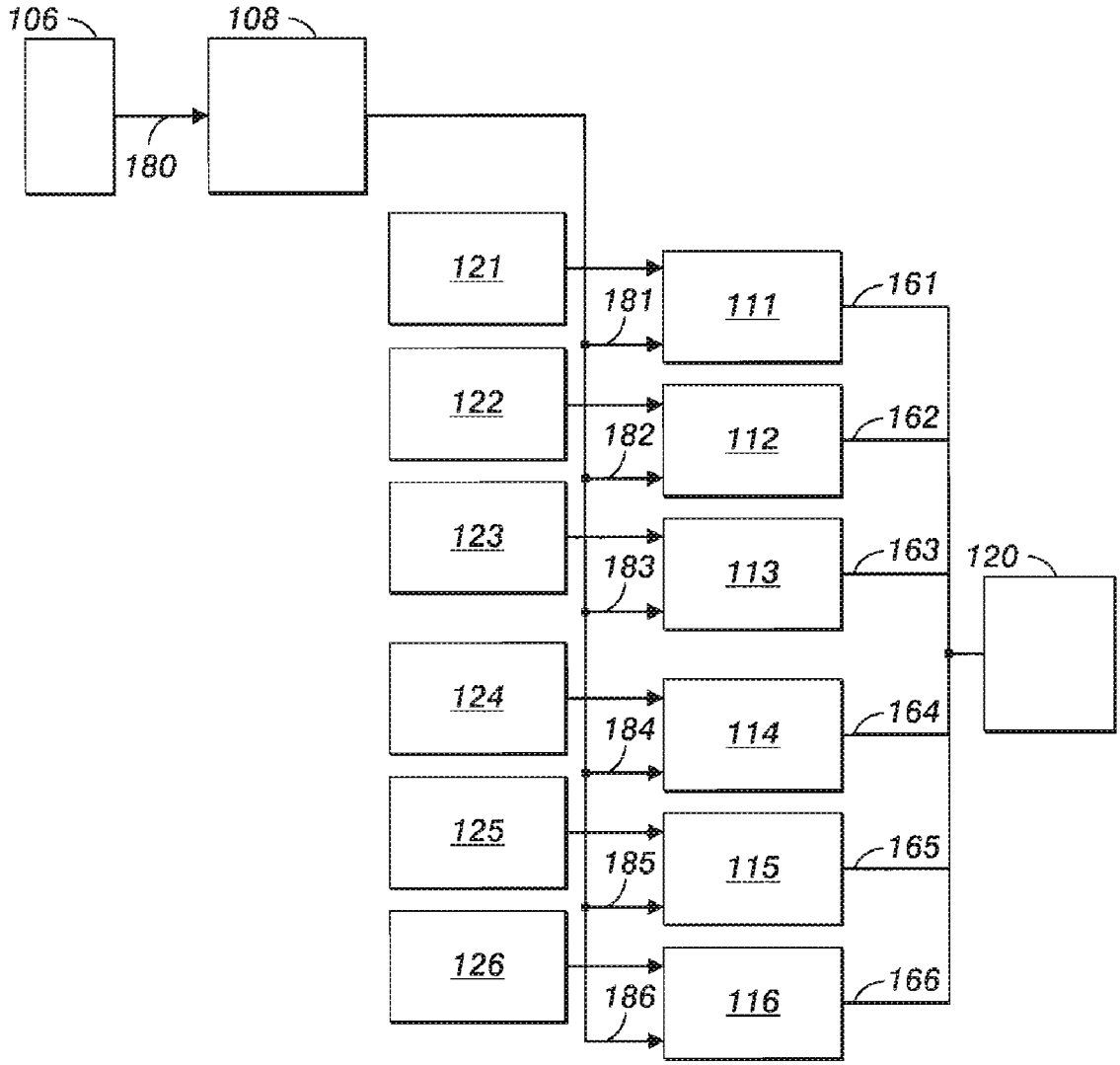
FIG. 3 illustrates an exemplary embodiment of a paper path configuration and a data path configuration of a continuous feed printing system for printing multi-layer documents having no less than two and no more than six printers.
Figure 4A:
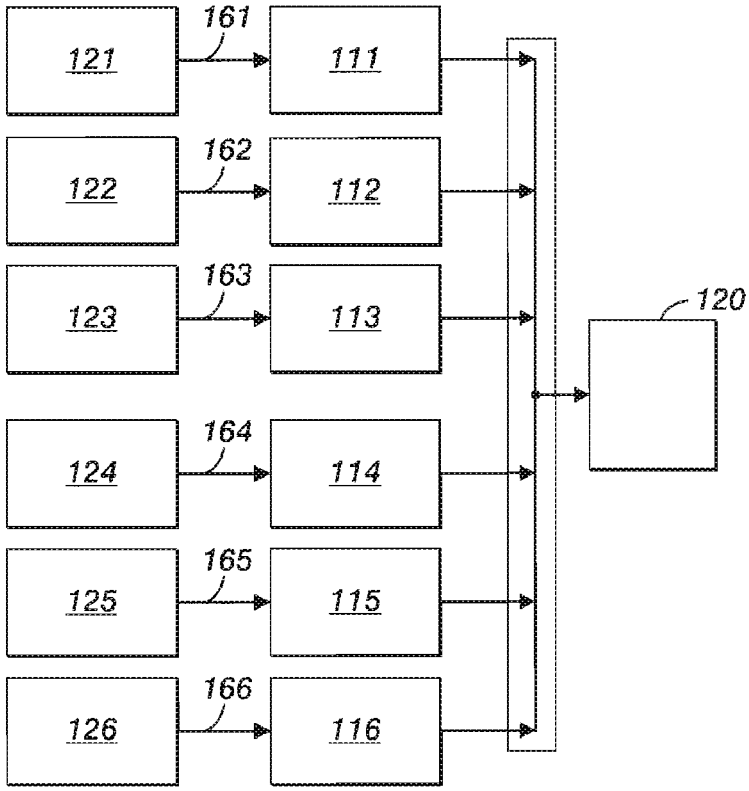
FIGS. 4(*a*)-4(*d*) illustrates various exemplary paper path configurations of a continuous feed printing system for printing multi-layer documents having no less than two and no more than six printers.
Figure 4B:
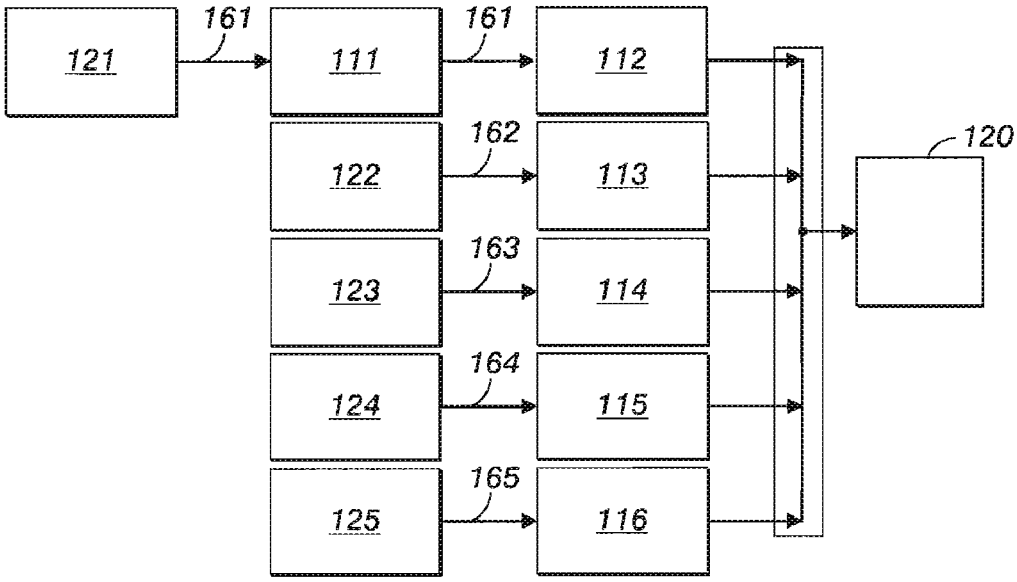
Figure 4C:
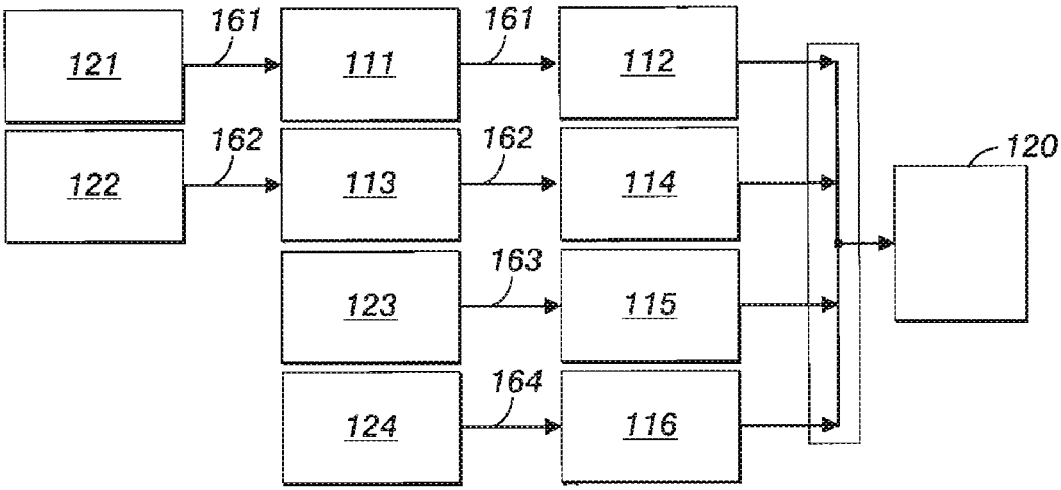
Figure 4D:
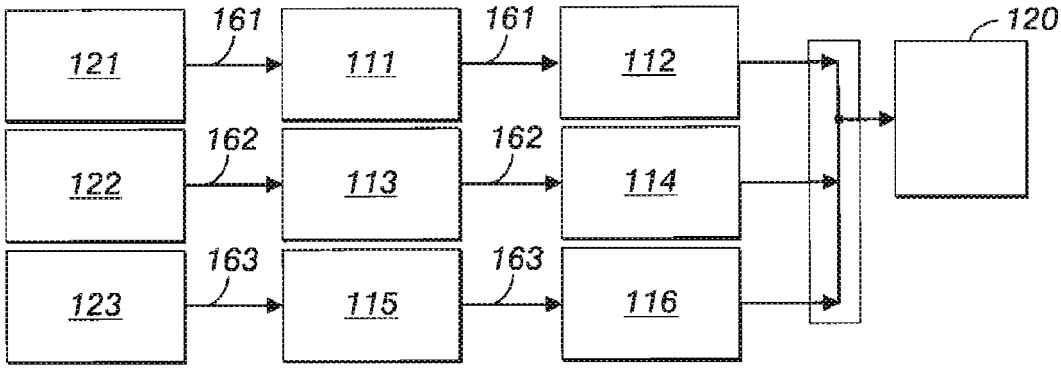

As shown in FIG. 3 an exemplary embodiment of a six-printer continuous printing system provides a controller 108 that receives a single document data flow 180 from a data flow source 106. The controller 108 creates a plurality of data layer flows 181-186, each of which is sent to a corresponding continuous feed printing device 111-116 for use in printing on a plurality of media webs 161-166. The printed media webs 161-166 from the printing devices 111-116 are merged into a multi-layer document 190 in a post-processing device 120.

FIGS. 4(*a*)-4(*d*) illustrate various exemplary possible paper path configurations of a continuous feed printing system for printing multi-layer documents having no less than two and no more than six printers 111-116. FIG. 4(*a*) illustrates operating no less than two printing devices 111 and 112 and no more than six printing devices 111-116 without duplex printing. FIG. 4(*b*) illustrates operating no less than three printing devices 111-113 and no more than six printing devices 111-116, with two printing devices 111 and 112 operating in a duplex printing configuration (i.e., in series) FIG. 4(*c*) illustrates operating no less than four printing devices 111-114 and no more than six printing devices 111-116, with four printing devices 111-114 operating in duplex printing configurations. FIG. 4(*d*) illustrates operating six printing devices 111-116, all six printing devices 111-116 operating in duplex printing configurations.

Figure 5A:
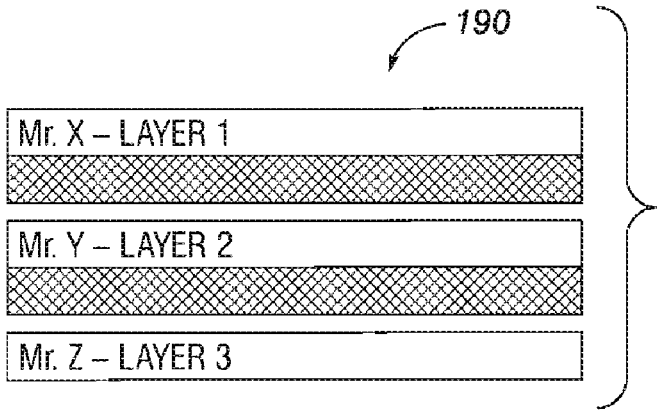
FIG. 5(*a*) illustrates a multi-layer document comprised of carbonless paper.
Figure 5B:
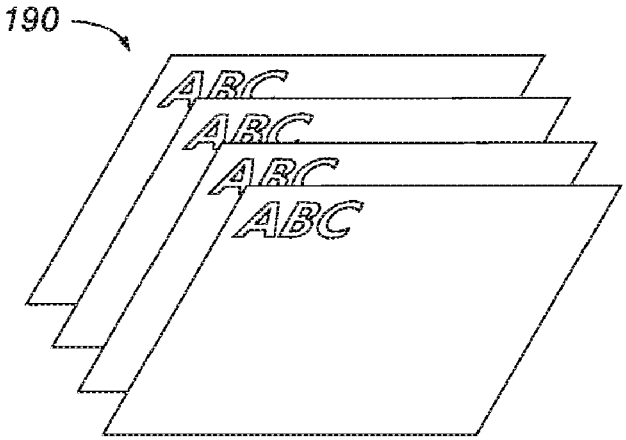
Figure 5C:
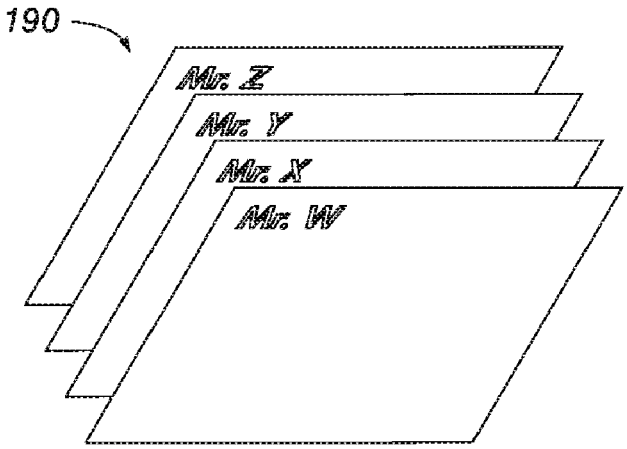

FIGS. 5(*a*)-5(*c*) illustrates various types of multi-layer documents 190 that may produced in exemplary embodiments of a continuous feed printing system. These types of multi-layer documents are for illustrative purposes, and other types of multi-layer documents may be produced by the printing systems disclosed herein. FIG. 5(*a*), for example, shows a multi-layer document comprised of carbonless paper such as may be used to created duplicate copies of forms. FIG. 5(*b*) shows an example of a multi-layer form in which each of the layers may be comprised of a different type of media web, such as, for example, webs of different colors. In this example, the same data is printed on each layer. FIG. 5(*c*) shows an example of a multi-layer document in which each of the layers is made of the same type of media, such as standard copy paper. In this example, distinctive data is printed on each layer. Various other multi-layer documents known in the art having different configurations of media web types (i.e., the same or different types of media for one or all layers) and different configurations of printed data (i.e., the same or distinctive data printed on one or all of the layers) may be produced utilizing the continuous feed printing systems and methods disclosed herein.

An exemplary embodiment of a system for printing a multi-layer document 190 is provided comprising no less than two and no more than six continuous feed simplex printing devices 111-116 that each print on no more than one of a plurality of media webs 161-166, and a post-processing device 120 that merges the media webs 161-166 into a multi-layer document 190. For use in producing multi-layer documents having at least three layers, the number of printing devices may be no less than three.

For use in duplex printing, the system may comprise a first printing device 111 and a second printing device 112 configured in series for duplex printing on a first media web 161. This configuration may be utilized with no less than one and no more than four additional printing devices 113-116. This duplex printing configuration may further comprise a second printing device 113 and a third printing device 114 also configured in series for duplex printing on a second media web 162. This second configuration may be utilized with up to two additional printing devices 115 and 116. A third set of printing devices 115 and 116 may also be configured in series for duplex printing on a third media web. The third configuration utilizes all of the six printing devices 111-116 in series to print on three media webs 161-163.

Figure 6A:
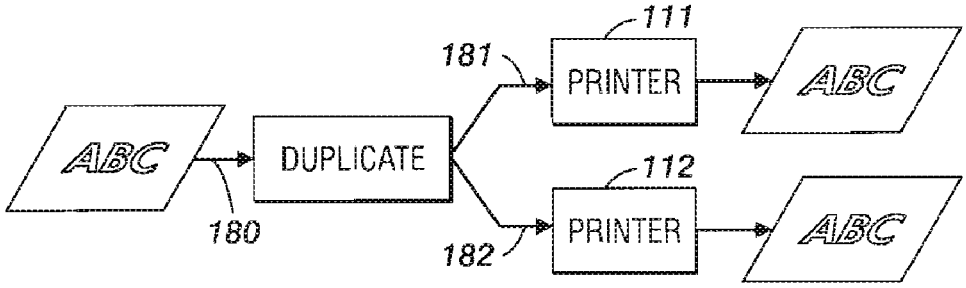
FIGS. 6(*a*)-6(*c*) illustrate various exemplary data flow configurations of a continuous printing system for printing multi-layer documents.
Figure 6B:
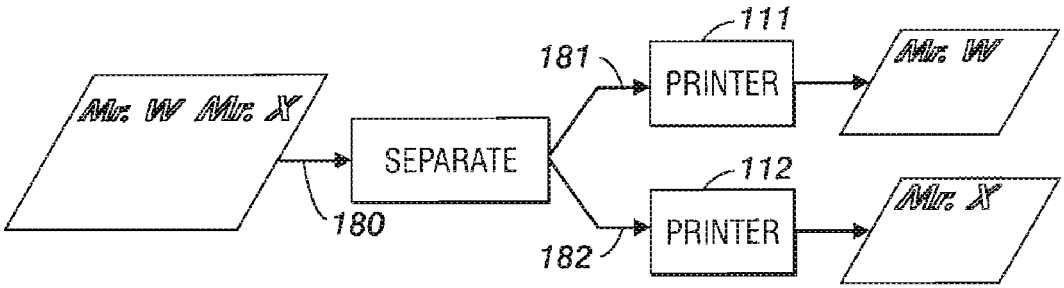
Figure 6C:
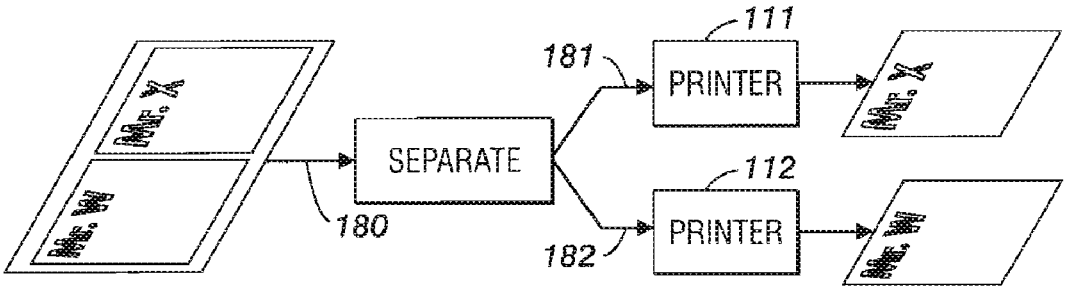

In various embodiments, the system for printing a multi-layer document may further comprise a controller 108 that controls the printing devices 111-116 and post-processor device 120 from a single synchronized data flow. As shown in FIGS. 6(*a*)-6(*c*), various possible data flow configurations may be utilized with the continuous printing system for printing multi-layer documents. FIG. 6(*a*) shows a configuration in which the controller 108 duplicates data from the document data flow 180 to send data layers 181 and 182 that are the same to printers 111 and 112. FIGS. 6(*b*) and 6(*c*) illustrate configurations in which the controller 108 separates data from the document data flow 180 to send data layers 181 and 182 that are different from each other to printers 111 and 112.

In various embodiments, the system for printing a multi-layer document may further comprise at least one pre-processing device 141-146 for each media web 161-166. The printing devices 111-116, pre-processing devices 141-146 and post processing device 120 may be connected to a common PLB 130 for receiving operation signals from the controller 108. A graphical user interface may be used to display a plurality of user-selectable print processing settings.

To assist in synchronizing the operation of the printing devices 111-116 and the post-processing device 120, at least one of the media webs 161 merged by the post-processing device 120 has synchronization marks which may be pre-printed or printed by at least one of the printing devices 111-116.

Figure 8:
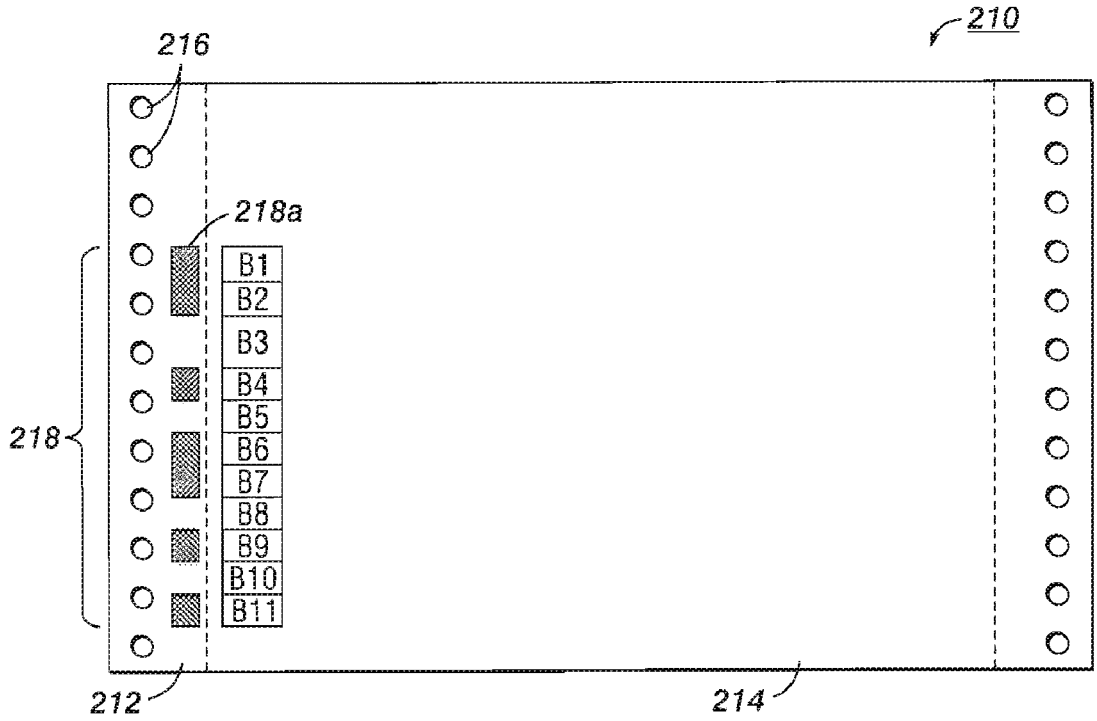
FIG. 8 is an exemplary synchronization mark printed on a web.

FIG. 8 illustrates an exemplary synchronization verification mark 218 that may be used to verify the good match of the different layers. The synchronization mark 218 shown in FIG. 8 is comprised of printed portions 218*a* that are printed entirely in the margin section 212 of the marked web 210, between sprocket holes 216 used to advance the marked web 210 and the printed section 214 of the marked web. Thus, the mark 218 does not interfere with the print section 214. The exemplary mark 218 is comprised of eleven bits B1 through B11 that may, for example provide the following information: Bits B1 and B2 may provide information that the mark has started (start bits), and are typically printed portions 218*a* of the mark. Bit B3 may provide information used for synchronization (sync bit), and are typically blank. Bit B3 in the exemplary mark 218 has a length that fifty percent greater than the other bits B1, B2 and B4-B11. Bit B4 may provide information concerning the side (side bit) (front or back) of the marked web 210. Bit 134 may be blank to indicate front-side of the marked web 210 or printed to indicate back side of the web 210. Bit B5 may be used to maintain parity (parity bit), and may be printed or left blank to maintain, for example, an odd number of total printed bits 218*a* in the mark 218. Bits 6 and 7 may be used for other commands (command bits). Bits B8-B11 may be used to identify page number (page ID bit) using binary code. Bits B8-B11 are the same on the front side and the back side of the marked web 210.

In various embodiments, the controller 108 receives a document data flow 180 from a document data flow source 106, creates no less than two, and preferably no more than six, data layer flows 181-186 from the document data flow 180, and sends each data layer flow 181-186 to a respective one of the plurality of continuous feed simplex printing devices 111-116 that each print, simultaneously, on no more than one of a plurality of media webs 161-166, and synchronizes the operation of a post-processing device 120 that merges the printed media webs 161-168 from the plurality of printing devices 111-116 into a multi-layer document 190. As previously discussed, the data flow layers 181-186 can be different, or alternatively, at least two of the data layer flows 181-186 can be the same. Further, all of the data flow layers 181-186 may be the same. In various embodiments, the controller 108 can control at least one preprocessing device 141-146 for each media web 161-166. The system 100 for printing a multi-layer document may also provide that the printing devices 111-116 and the post-processing device 120 are connected to a common PLB 130 for receiving operation signals from the controller 108.

Figure 7:
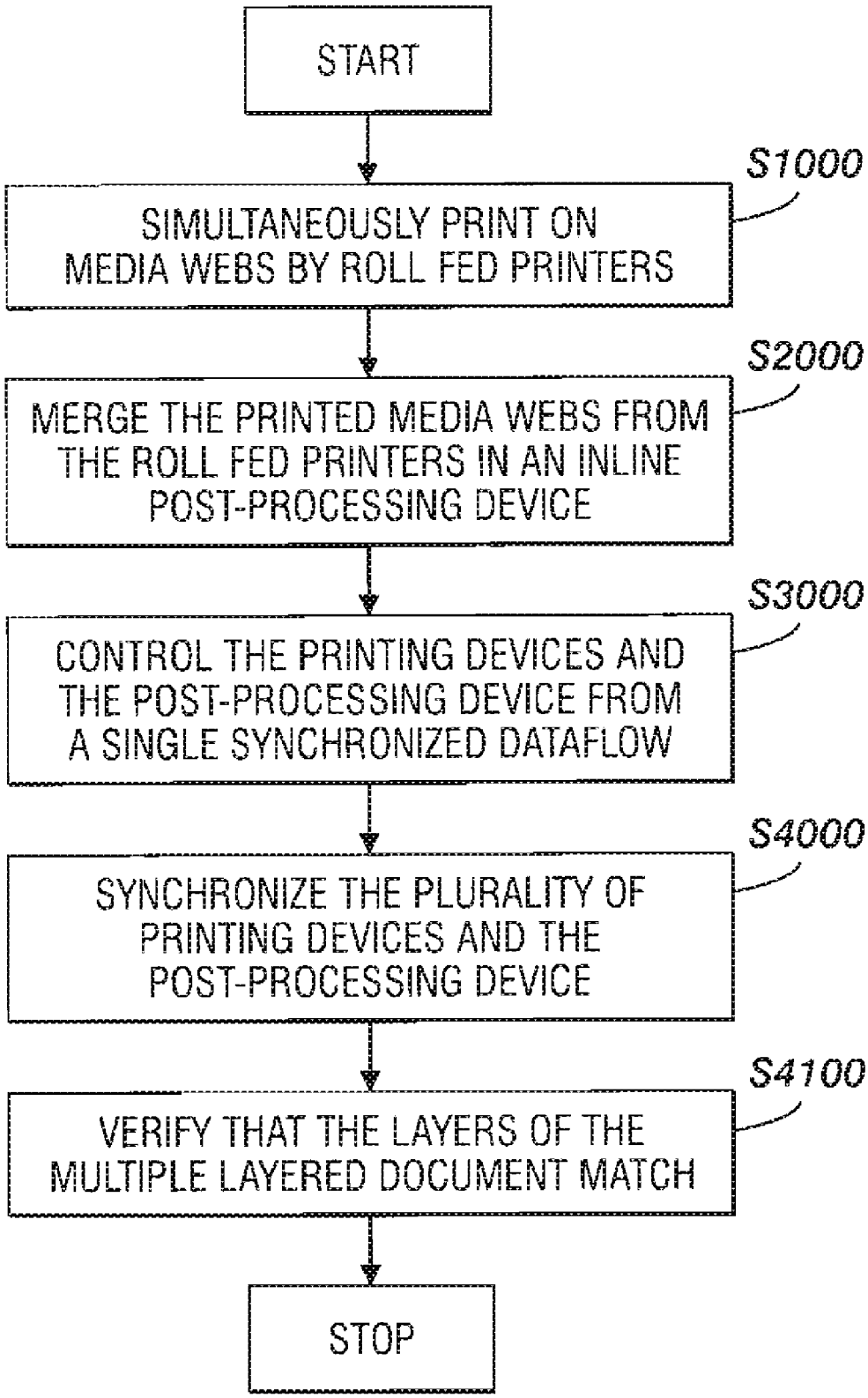
FIG. 7 is a flowchart illustrating an exemplary method of operating a continuous printing system for printing multi-layer documents.

As shown in FIG. 7, an exemplary method for printing a multi-layer document is illustrated. In step S1000, printing is performed simultaneously on no less than two, and preferably no more than six, media webs by a plurality of roll fed printers that each print on only one of the media webs. In step S2000, the media webs from the plurality of roll fed printers are merged in an inline post-processing device. The method may further include the steps of S4000 synchronizing the plurality of printers and the post-processing device, and S4100 verifying that the layers of the multi-layer document match using synchronization marks printed on each of the webs. In various embodiments, the method for printing a multi-layer document 190 may further include the step of S3000 controlling the plurality of printers 111-116 and the post-processing device 120 from a single synchronized dataflow 180.

Although a maximum of six printing devices are shown in the exemplary embodiments, more than six printing devices can be used.

Synchronization between printers and devices as well as printers and printers, can be made through the usage of signals describing, for example, (1) the paper advance (paper pulse); (2) the printers readiness to advance paper (cycle up); (3) the printer ready state (ready), (3) the indication that the device/printers are connected (connected); and (4) the error state (error). Other signals can be used to control operation of the devices, such as, for example, a control signal to eject/advance a single page (one page), to stop the printer and keep the printer cycle up (soft stop), and eject the printed pages up to the finishing equipment.

Figure 9:
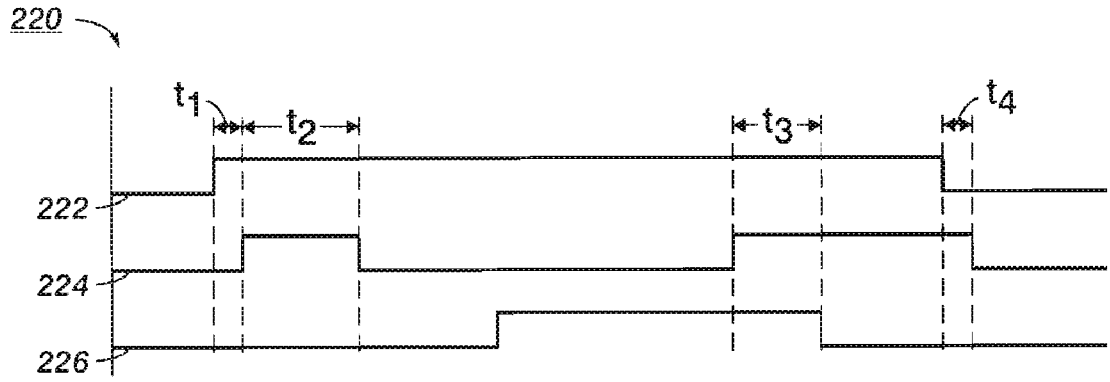
FIG. 9 is a diagram illustrating a timing sequence for controlling a continuous feed printing system.

An example control sequence is provided in FIG. 9, providing a timing sequence for controlling a continuous feed printing system that illustrates an advance warning and pause exchange signal sequence. Such timing sequences define the causality between pre-processing, printing and post-processing devices in a in continuous feed printing systems that print multi-layer documents. The timing sequence 220 provides an advance warning device input signal 222 from the controller 108. The advance warning signal 222 toggles between assertion, in which a paper input motor is activated to nominal speed, to deassertion, in which the paper input motor is deactivated. The device, in turn, provides an output pause signal 224 that toggles between assertion, in which paper stops if it was moving, and deassertion, in which paper resumes advance as soon as the device is ready to start.

The timing sequence 220 illustrates the paper advance 226 in response associated with the advance warning and pause exchange signal sequence. The durations t1 and t4 represent relatively short delays associated with a change in the advance warning signal 222 and the pause signal 224. The duration t2 is a paper start delay between the pause signal 224 deassertion and the commencement of paper. The duration t3 is a paper stop delay, the time it takes for the paper advance to stop after the pause signal 224 assertion. Control signal sequences such as provided, for example, in FIG. 9, are used to define the causality between and to synchronize the operation of the pre-processing, printing, and post-processing devices in continuous feed printing systems that print multi-layer documents.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A system for printing a multi-layer document, the system comprising:

no less than two continuous feed simplex printing devices that each print on no more than one of a plurality of media webs;

a post-processing device that merges the media webs output by the printing devices into a multi-layer document, the post-processing device is in-line with the printing devices; and a controller that controls the printing devices and the post-processor device, the controller being configured to receive a single synchronized dataflow from the printing devices.

2. A system for printing a multi-layer document according to claim 1, wherein the number of printing devices is no less than three.

3. A system for printing a multi-layer document according to claim 2, wherein the printing devices comprise a first printing device and a second printing device disposed in series for duplex printing on a first media web.

4. A system for printing a multi-layer document according to claim 3, wherein the printing devices further comprise a third printing device and a fourth printing device disposed in series for duplex printing on a second media web.

5. A system for printing a multi-layer document according to claim 4, wherein the printing devices further comprise a fifth printing device and a sixth printing device disposed in series for duplex printing on a third media web.

6. A system for printing a multi-layer document according to claim 1, further comprising at least one pre-processing device for each of the media webs.

7. A system for printing a multi-layer document according to claim 1, wherein the printing devices and the post-processing device are connected to a common PLB for receiving operation signals from the controller.

8. A system for printing a multi-layer document according to claim 1, wherein at least one of the media webs merged by the post-processing device has synchronization marks to synchronize operation of the printing devices.

9. A system for printing a multi-layer document according to claim 8, wherein the synchronization marks are pre-printed.

10. A system for printing a multi-layer document according to claim 8, wherein the synchronization marks are printed by at least one of the printing devices.

* * * * *